US009212856B2

(12) United States Patent
Baker

(10) Patent No.: US 9,212,856 B2
(45) Date of Patent: Dec. 15, 2015

(54) GAS CUT-OFF SYSTEM FOR FIREARMS

(71) Applicant: RA BRANDS, L.L.C., Madison, NC (US)

(72) Inventor: Travis T. Baker, Elizabethtown, KY (US)

(73) Assignee: RA Brands, L.L.C., Madison, NC (US)

( * ) Notice: Subject to any disclaimer, the term of this patent is extended or adjusted under 35 U.S.C. 154(b) by 42 days.

(21) Appl. No.: 13/799,088

(22) Filed: Mar. 13, 2013

(65) Prior Publication Data

US 2014/0174285 A1 Jun. 26, 2014

Related U.S. Application Data

(60) Provisional application No. 61/848,171, filed on Dec. 26, 2012.

(51) Int. Cl.

| | |
|---|---|
| ***F41A 5/28*** | (2006.01) |
| ***F41A 5/18*** | (2006.01) |
| ***F41A 5/22*** | (2006.01) |

(52) U.S. Cl.

CPC ... *F41A 5/18* (2013.01); *F41A 5/22* (2013.01); *F41A 5/28* (2013.01)

(58) Field of Classification Search

CPC ..... F41A 5/18; F41A 5/26; F41A 5/28; F41A 5/20; F41A 5/22; F41A 5/24

USPC ..... 89/191.01, 193, 192, 191.02, 183, 179, 89/159, 156, 129.01

See application file for complete search history.

(56) References Cited

U.S. PATENT DOCUMENTS 2,715,858 A 8/1955 Hoppert
2,777,366 A * 1/1957 Cook ..... 89/193

(Continued)

FOREIGN PATENT DOCUMENTS

CH 665712 A5 5/1988
EP 0158707 A2 10/1985

(Continued)

OTHER PUBLICATIONS

International Search Report dated Apr. 25, 2014 for International Application No. PCT/US2013/076999 filed Dec. 20, 2013.

(Continued)

*Primary Examiner* — Samir Abdosh
*Assistant Examiner* — John D Cooper
(74) *Attorney, Agent, or Firm* — Womble Carlyle Sandridge & Rice, LLP

(57) ABSTRACT

A gas cutoff system for use with a gas-operated firearm. The gas cutoff system includes a gas block affixed to the barrel and having a plurality of openings adjacent the barrel for receiving gas redirected from the barrel of the firearm upon firing. At least one gas cylinder is disposed within the gas block and includes a piston disposed within and moveable along the gas cylinder. A valve assembly is disposed within the gas cylinder adjacent to the at least one piston. The valve assembly includes a selectively closeable valve that can be actuated upon firing of the firearm when the volume/pressure of gas entering the gas block through the plurality of openings overcomes a biasing force of a spring so as to actuate movement of the valve within the gas cylinder. A portion of the valve is moved to a location blocking the openings through which the gas is entering the gas block to prevent excess gas from entering the gas operating system.

20 Claims, 12 Drawing Sheets

(56) References Cited

U.S. PATENT DOCUMENTS

| | | | | |
|---|---|---|---|---|
| 2,895,383 | A | 7/1959 | Reed | |
| 3,020,807 | A | 2/1962 | Hailston et al. | |
| 3,127,812 | A * | 4/1964 | Into et al. | 89/193 |
| 3,568,564 | A | 3/1971 | Badali | |
| 3,968,727 | A | 7/1976 | Hyytinen | |
| 3,990,348 | A | 11/1976 | Vesamaa | |
| 4,085,654 | A | 4/1978 | Panigoni | |
| 4,102,242 | A * | 7/1978 | Liedke | 89/191.01 |
| 4,102,243 | A | 7/1978 | Jennie | |
| 4,125,054 | A | 11/1978 | Jennie | |
| 4,174,654 | A | 11/1979 | Liedke | |
| 4,373,423 | A | 2/1983 | Moore | |
| 4,389,920 | A | 6/1983 | Dufour, Sr. | |
| 4,414,880 | A | 11/1983 | Throner | |
| 4,702,146 | A | 10/1987 | Ikeda et al. | |
| 4,872,392 | A | 10/1989 | Powers et al. | |
| 4,901,623 | A | 2/1990 | Lee | |
| 5,218,163 | A | 6/1993 | Dabrowski | |
| 5,272,956 | A | 12/1993 | Hudson | |
| 5,388,500 | A | 2/1995 | Petrovich | |
| 5,959,234 | A * | 9/1999 | Scaramucci et al. | 89/193 |
| 6,374,720 | B1 | 4/2002 | Tedde | |
| 6,508,160 | B2 | 1/2003 | Beretta | |
| 6,715,396 | B2 | 4/2004 | Dionne | |
| 6,971,202 | B2 | 12/2005 | Bender | |
| 6,973,863 | B1 | 12/2005 | Jones | |
| 7,258,056 | B2 | 8/2007 | Guesnet et al. | |
| 7,810,423 | B2 | 10/2010 | Monroe | |
| 7,832,326 | B1 * | 11/2010 | Barrett | 89/191.01 |
| 7,856,917 | B2 | 12/2010 | Noveske | |
| 7,891,284 | B1 | 2/2011 | Barrett | |
| 7,926,404 | B2 | 4/2011 | Brittingham | |
| 7,942,090 | B1 | 5/2011 | Hoffman | |
| 7,946,214 | B2 | 5/2011 | Stone | |
| 8,042,448 | B1 | 10/2011 | Sylvester et al. | |
| 8,065,949 | B1 * | 11/2011 | Molinari | 89/193 |
| 8,161,864 | B1 | 4/2012 | Vuksanovich | |
| 8,201,489 | B2 | 6/2012 | Juarez | |
| 8,245,625 | B2 | 8/2012 | Winge | |
| 8,250,964 | B2 | 8/2012 | Stone | |
| 8,261,653 | B2 | 9/2012 | Crommett | |
| 8,316,756 | B1 | 11/2012 | Woodell et al. | |
| 8,393,259 | B2 * | 3/2013 | Larue | 89/193 |
| 2005/0115398 | A1 | 6/2005 | Olson | |
| 2006/0278205 | A1 | 12/2006 | Axelsson | |
| 2009/0229454 | A1 | 9/2009 | Fluhr et al. | |
| 2010/0071541 | A1 | 3/2010 | Barrett | |
| 2010/0275770 | A1 | 11/2010 | Noveske | |
| 2011/0107900 | A1 | 5/2011 | Presz, Jr. et al. | |
| 2012/0167749 | A1 | 7/2012 | Young | |
| 2012/0167756 | A1 | 7/2012 | Larue | |
| 2012/0167757 | A1 | 7/2012 | Gomez | |

FOREIGN PATENT DOCUMENTS

| | | |
|---|---|---|
| GB | 747371 | 4/1956 |
| WO | WO 2010-123604 A2 | 10/2010 |

OTHER PUBLICATIONS

Written Opinion dated Apr. 25, 2014 for International Application No. PCT/US2013/076999 filed Dec. 20, 2013.

Jacob Gottfredson, Standing ready: Sig Sauers 516 patrol rifle, Guns Magazine, Mar. 1, 2012, pp. 68-70, vol. 58, issue 3, Publishers Development Corporation.

Michael O. Humphries, SIG Sauer SIG556 Classic, Aug. 23, 2012, 2 pages, National Rifle Association, http://www.americanrifleman.org/ArticlePage.aspx?id=1661&cid=4.

* cited by examiner

GAS CUT-OFF SYSTEM FOR FIREARMS

CROSS-REFERENCE TO RELATED APPLICATION

This application claims the benefit of U.S. Provisional Patent Application Ser. No. 61/848,171, filed on Dec. 26, 2012. The specification and drawings of the provisional patent application are specifically incorporated by reference herein.

TECHNICAL FIELD

The present invention generally relates to gas operating systems for firearms and, more particularly, to the regulation of gas operating systems for firearms.

BACKGROUND OF THE INVENTION

Semi-automatic firearms, such as rifles and shotguns, are designed to fire a round of ammunition, such as a cartridge or shotshell, in response to each squeeze of the trigger of the firearm, and thereafter automatically load the next shell or cartridge from the firearm magazine into the chamber of the firearm. During firing, the primer of the round of ammunition ignites the propellant (powder) inside the round, producing an expanding column of high pressure gases within the chamber and barrel of the firearm. The force of this expanding gas propels the bullet/shot of the cartridge or shell down the barrel.

In semi-automatic rifles and shotguns, and in particular in gas operated firearms, a portion of the expanding gases from firing typically are directed through a duct or port that interconnects the barrel of the firearm to a piston assembly that generally houses an axially moveable piston, which interacts with the bolt assembly of the firearm to cause cycling of the bolt assembly.

During a firing operation, a portion of the expanding combustion gases from the barrel is directed into the gas block of the gas operating system, the gas flow contacting and driving the gas piston rearwardly. This rearward action of the gas piston, which in turn is translated to the bolt, functions to cause a spent cartridge/shell casing to be automatically cleared or ejected from the chamber, a new round to be loaded into the chamber, and the hammer to be recocked for a next firing cycle. The gases directed into the gas block generally result from combustion of the primer and propellant powder of the round upon firing of the round.

Known gas actuating piston assemblies for semi-automatic firearms can suffer from numerous disadvantages, including the inability to regulate the gas energy being transmitted to the piston. For example, when lower power cartridges or shells are used, the pressure of the discharge gases sometimes is not sufficient to properly or fully actuate/drive the piston assembly, which can result in failure to fully cycle the action or jammed shells or cartridges.

SUMMARY

In one embodiment of the invention, a gas cutoff system is provided for use with a gas-operated firearm including a barrel and receiver. The gas cutoff system includes a gas block affixed to the barrel and including a plurality of openings adjacent the barrel for receiving gas redirected from the barrel of the firearm upon firing. At least one gas cylinder is disposed within the gas block and includes a piston disposed within and moveable along the gas cylinder. A valve assembly is disposed within the gas block adjacent to the at least one gas cylinder. The valve assembly includes a selectively closable valve that regulates an energy input to the gas operating system.

In one embodiment, the gas block can include a gas plug that is securely threaded into one end of the gas block. A spring can be slideably mounted on an outer surface of the gas plug in a cutout section of the gas block engaging a forward end of the valve assembly. The valve can be actuated upon firing of the firearm when the volume/pressure of gas entering the gas block through the plurality of openings exceeds a level sufficient to overcome a biasing force of the spring so as to actuate movement of the valve within the gas cylinder. As a result, a portion of the valve is moved to a location blocking the opening(s) through which the gas is entering the gas block from the barrel to prevent too much excess gas entering the gas operating system.

In one embodiment, the gas block can be brazed to the outside of the barrel. In another embodiment, there can be two gas cylinders disposed in the gas block with each gas cylinder symmetrically positioned on an opposite side of the barrel and each including a selectively closable valve. Furthermore, the pistons disposed within each gas cylinder generally will extend through one end of the gas block and into the receiver of the firearm. In one embodiment, the spring can be mounted over the gas plug such that the spring is in contact with the gas block at a first end and presses against a rim of the valve at a second end of the spring. In addition, the valve contains an orifice or opening the size of which is tuned to allow the optimal amount of gas to flow into the gas cylinder. The body of the valve is cylindrical with the outer diameter of the valve body being designed to create a sliding seal in the gas cylinder, and the inner diameter being designed such that the resulting annular surface at the rear end of the valve which is exposed to the pressure of the gas in the gas cylinder determines the pressure level inside the gas cylinder at which sufficient force is exerted by the valve on the spring to overcome the biasing force of the spring and allow the valve to actuate.

BRIEF DESCRIPTION OF THE DRAWINGS

These and other advantages and aspects of the embodiments of the disclosure will become apparent and more readily appreciated from the following detailed description of the embodiments taken in conjunction with the accompanying drawings, as follows.

DETAILED DESCRIPTION

The following description is provided as an enabling teaching of embodiments of the invention including the best, currently known embodiment. Those skilled in the relevant art will recognize that many changes can be made to the embodiments described, while still obtaining the beneficial results. It will also be apparent that some of the desired benefits of the embodiments described can be obtained by selecting some of the features of the embodiments without utilizing other features. Accordingly, those who work in the art will recognize that many modifications and adaptations to the embodiments described are possible and may even be desirable in certain circumstances. Thus, the following description is provided as illustrative of the principles of the invention and not in limitation thereof, since the scope of the invention is defined by the claims.

Generally, a gas operating system includes a gas piston and a gas plug adapted to be received within and housed by the gas block. The gas block further includes a first, proximal or front end, a second, rear or distal end, and a gas block bore extending longitudinally therethrough. The gas block is attached to the barrel in a location such that the barrel orifice generally aligns with a gas port or inlet for the gas block bore, which extends through the gas block between the barrel orifice and the gas block bore. The aligned barrel orifice and gas port enable a portion or flow of combustion gases to communicate from the bore of the barrel into the gas block bore.

Generally, the gas piston slides along the gas block bore (cylinder) of the gas block housing after firing, the gas piston being slideable within the gas block bore and along the gas block for a desired amount of travel. The gas piston extends beyond the rearward end of the gas block bore and through the clearance bore of the bushing of the barrel extension for engaging the bolt assembly in the receiver. The gas piston can be biased to a position where a reduced diameter portion of the gas piston, or other portion capable of receiving the gases, is generally aligned with the gas port so as to enable a passage of gases from the barrel into the gas block bore.

Figure 1:
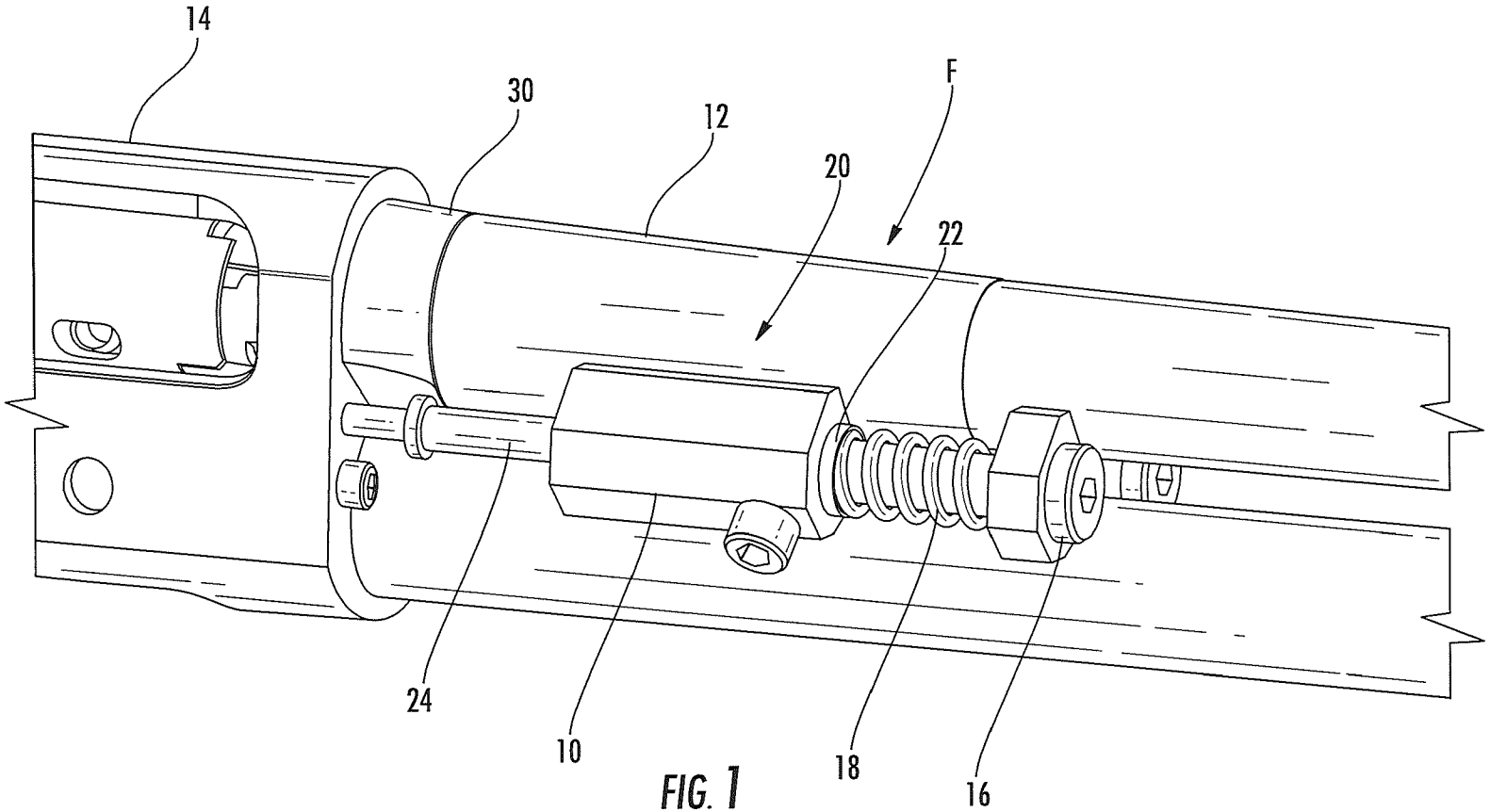
FIG. 1 illustrates a perspective view of a gas cutoff system prototype.
Figure 2:
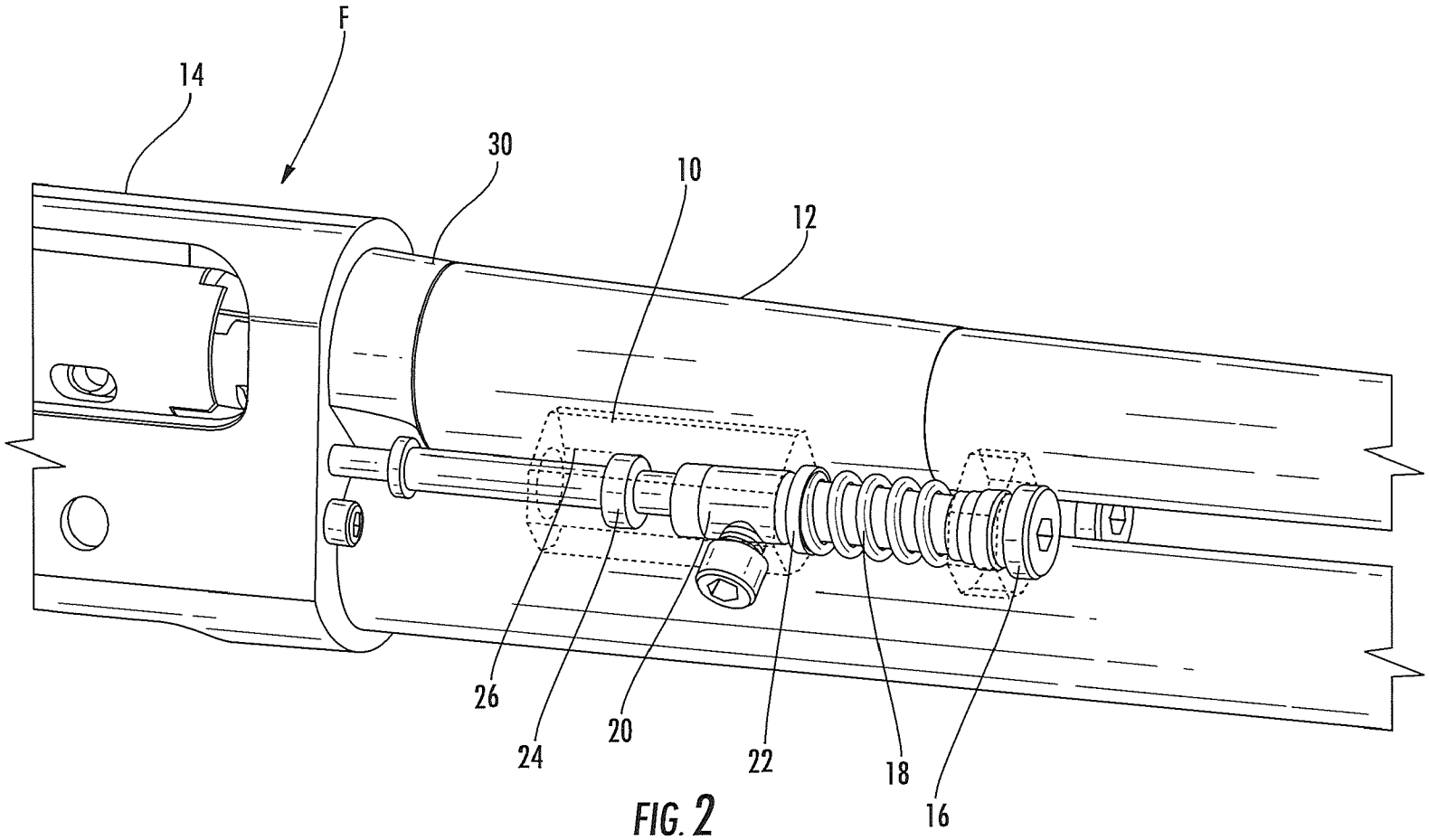
FIG. 2 illustrates a perspective view of a gas cutoff system prototype in which the gas block is depicted as transparent.

With reference to FIGS. 1-2, firearms F that can utilize the gas cut off systems in accordance with the principles of the invention, as shown by the disclosed embodiments can include a variety of gas-operated firearms, including automatic and semi-automatic rifles, shotguns and other long guns and handguns. In one prototype embodiment shown in FIGS. 1-2, the firearm generally includes a barrel 12, a receiver 14, a fire control (not shown), a stock (not shown), and a gas operating system with a gas block 10. The receiver 14 houses and includes the firing mechanism or fire control, including a trigger for actuating the firearm, a breech bolt or bolt assembly, and a firing pin. The bolt assembly is translatable axially in both forward and rearward directions along the receiver 14 during the firing cycle and generally is located behind and communicates with a chamber portion located at an end of the barrel 12 adjacent or at least partially within the receiver 14. The chamber receives a round of ammunition, such as a shell or cartridge for firing. The barrel 12 generally includes a shoulder 30 at the receiver end of the barrel, and at least one barrel orifice, and can be connected to the receiver 14 by a magazine cap and a barrel extension.

The disclosed embodiments effectively control the energy input to the operating system of the firearm. This in turn allows for a more reliable operating system and reduces the opportunity to overstress and fail components in the action of the firearm.

Typically, a gas system will allow as much gas as can physically flow through the orifices to enter the system. Excess gas is bled off usually with a spring-loaded valve. In an exemplary embodiment, the gas system actually meters, or cuts off, or stops the flow of gas into the gas system to deal with excess gas. Rather than allowing free flow of gases into the gas block 10 and bleeding off the excess gas, the disclosed embodiments stop the flow of gas to prevent the gas system from getting too much energy.

In one exemplary embodiment, a gas operating system is provided for a firearm, such as a shotgun. FIGS. 1-2 illustrate a perspective view of a gas cutoff system with the gas block 10 shown transparently in FIG. 2 to show the location of the assembly, including selectively closeable valve 20, gas cylinder 26, and piston 24 components in the gas block 10.

The gas block 10 including two cylinder bores is attached to the barrel 12. A piston 24 is then inserted into each cylinder bore. The valve which has an exterior rim 22 exceeding the diameter of the cylinder bore is inserted into the cylinder bore until the valve rim 22 physically contacts an outer edge of the gas block 10.

As further illustrated in FIGS. 1-2, gas operating systems can include a gas block 10 attached/mounted to the barrel 12 of the firearm, such as by brazing, at a position where gas from the fired round can be redirected into the system and used to cycle the action of the firearm. The gas block 10 also has openings, holes, ports or orifices allowing the transfer of gas from the barrel 12 into the gas cylinder 26. The disclosed embodiment incorporates valve 20 housed in the gas cylinder 26 of gas block 10 adjacent to the piston 24. Valve 20 initially is held in position by a spring 18 allowing free passage of the gas from the barrel 12 through the gas block 10 through the valve 20 and into the gas cylinder 26. When the gas from the barrel 12 enters the gas cylinder 26 through an orifice in gas block 10, it acts upon the valve 20 eventually overcoming the force of the spring 18 and actuating the valve 20. This forward movement of the valve 20 causes a portion of the valve 20 to block the orifice or opening through which gas is entering the gas cylinder 26 in gas block 10. This action, in effect, regulates the amount of gas that is allowed to enter the gas cylinder 26 and thereby regulates the energy input to the piston 24 and in turn to the action of the firearm. In other words, rather than releasing excess gas from the gas cylinder 26, the valve 20 blocks the flow of excess gas before it can enter the gas cylinder 26.

In one embodiment, the valve 20 inside the gas cylinder 26 of gas block 10 includes a rim 22 that is positioned on the outside edge of the gas cylinder 26 when the valve 20 is inserted adjacent to the piston 24 in the gas cylinder 26. The gas cutoff system can include a gas cylinder 26 on each side of the gas block 10. When the gas block 10 is brazed to the barrel 12, each gas cylinder in the gas block is positioned on an opposite side of the barrel. Gas from the barrel 12 exiting the barrel orifice enters the gas cylinder 26 through an orifice in the valve 20 that is located adjacent to the piston 24 in the gas cylinder 26. Once gas flows into the gas block 10 through the valve orifice, it acts on the valve 20 and causes the valve 20 to move forward in the same direction that a projectile would exit the muzzle of the barrel 12. In moving in a forward direction, the valve 20 compresses the spring 18 and the orifice in the valve 20 basically is blocked off, so that no additional gas can flow through the valve 20 into the piston/cylinder area.

The spring forces acting on spring 18 can be tuned for the gas cutoff system for a particular firearm, along with orifice sizes and other parameters. Following compression of the spring 18, the spring force acts on the valve 20 to return the valve 20 to its original position for the next shot to be fired. In one embodiment, the valve 20 could move forward about an eighth of an inch, just enough to cover the orifice in the valve 20. In one embodiment, the hole cut in the gas block 10 is larger than the hole in the barrel 12. A smaller hole is drilled in the valve 20 and is positioned adjacent to the larger hole in the gas block 10. As the valve 20 moves, it is no longer adjacent the hole in the gas block 10, thus cutting off the flow of gas into the gas block 10.

Figure 3A:
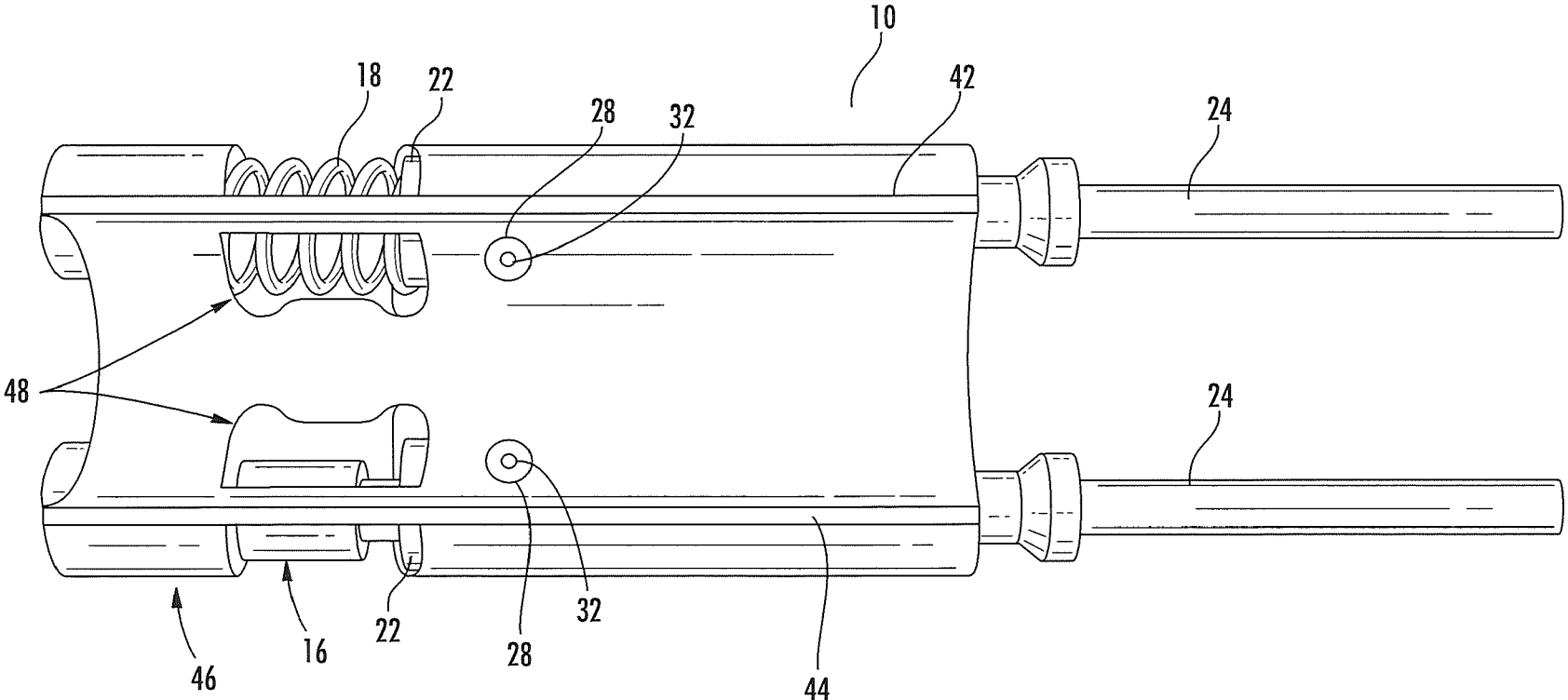
FIGS. 3A-3B illustrate perspective top and bottom views, respectively, of the gas block in an exemplary embodiment.
Figure 3B:
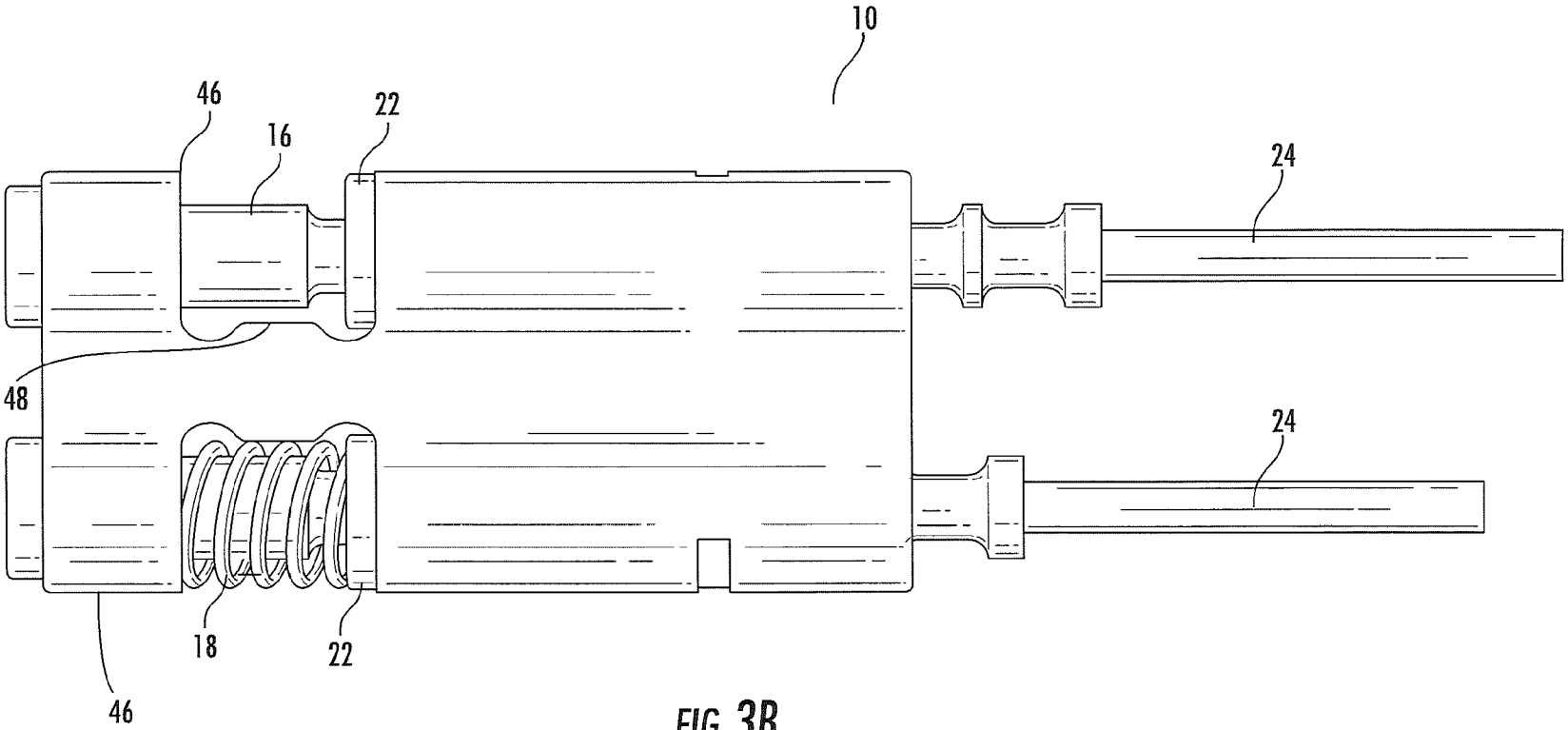
Figure 3C:
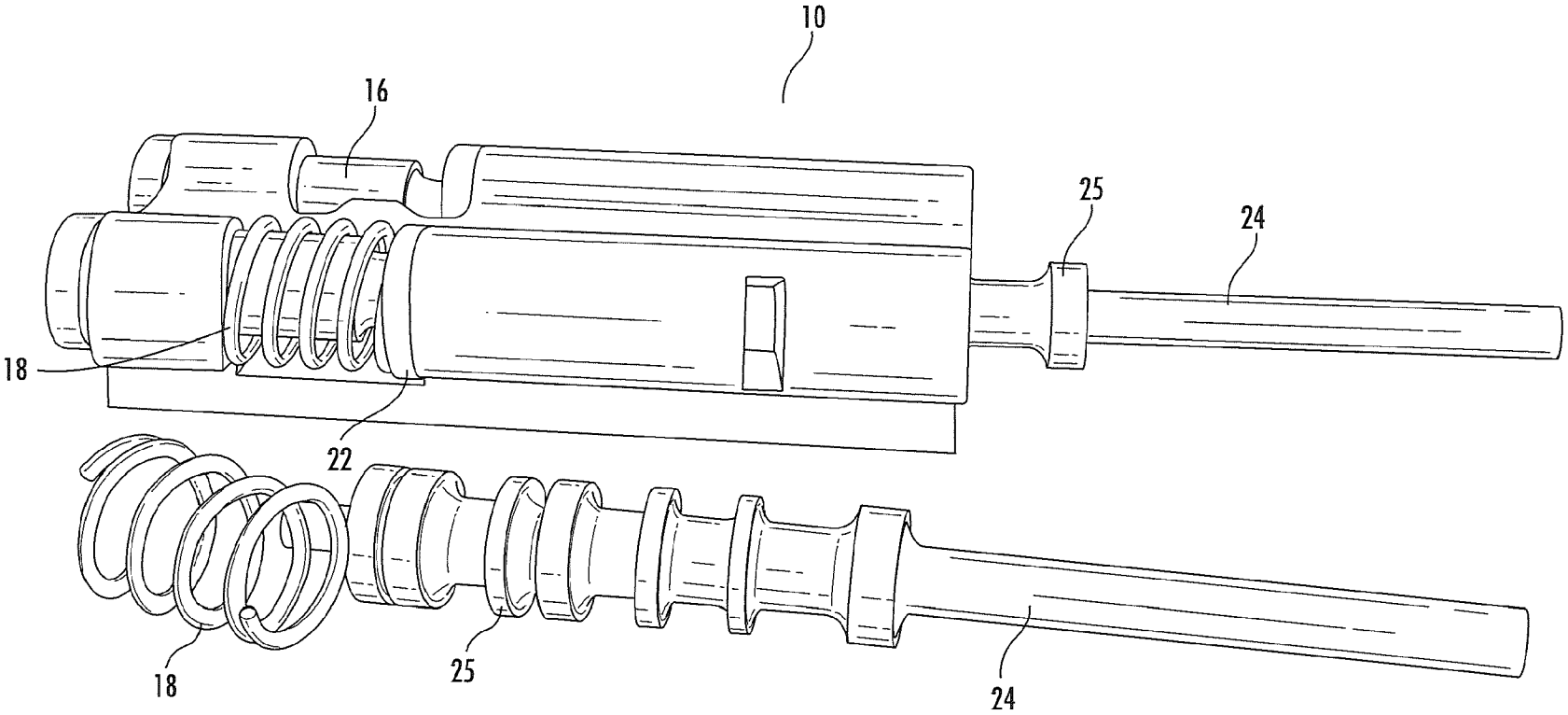
FIG. 3C illustrates a perspective view of the gas block spring and piston in an exemplary embodiment.

FIGS. 3A-3B illustrate perspective top and bottom views, respectively, of the gas block 10 in an exemplary embodiment. In more detail, FIGS. 3A-3B show the cutout section 48, front section 46, gas plug 16, valve rim 2, gas block orifices 28, top edges of the gas block 42, 44, piston 24, and spaced-apart ridges 25. FIG. 3C illustrates a perspective view of the gas block and the spring 18 and piston 24 components in an exemplary embodiment. FIGS. 5-10 illustrate different views of the gas cut-off system in an exemplary embodiment.

As illustrated in FIGS. 3A-3C and FIGS. 5-10, the spring 18 is positioned over an outer surface of a gas plug 16. In one embodiment, the gas plug 16 is threaded into the gas block 10 with the inserted end extending to about the middle of the valve 20. The gas plug 16 includes a metallic seal or O-ring sealing the gas plug inside the gas cylinder 26. The spring 18 slides over the gas cylinder plug 16, one end pressing against a rim 22 of the valve 20, the other end pressing against a portion 46 defining one end of a cutout section of the gas block 10.

In one embodiment, each gas cylinder 26 of the gas block 10 operates independently of the other. However, both should function in the same manner since each gas cylinder 26 has the same amount of energy with each gas cylinder 26 having the same orifices drilled into them. Each gas cylinder 26 has its own valve 20 and piston 24 and operates against a spring 18 in the gas block 10 on each side of the barrel 12. The gas cylinders 26 are not physically connected to each other and could be located at varying positions in the gas block depending on performance requirements. In exemplary embodiments, the components of the gas cutoff system could be made from hardened steel with ceramic-type coatings on the surface for wear resistance.

Figure 4:
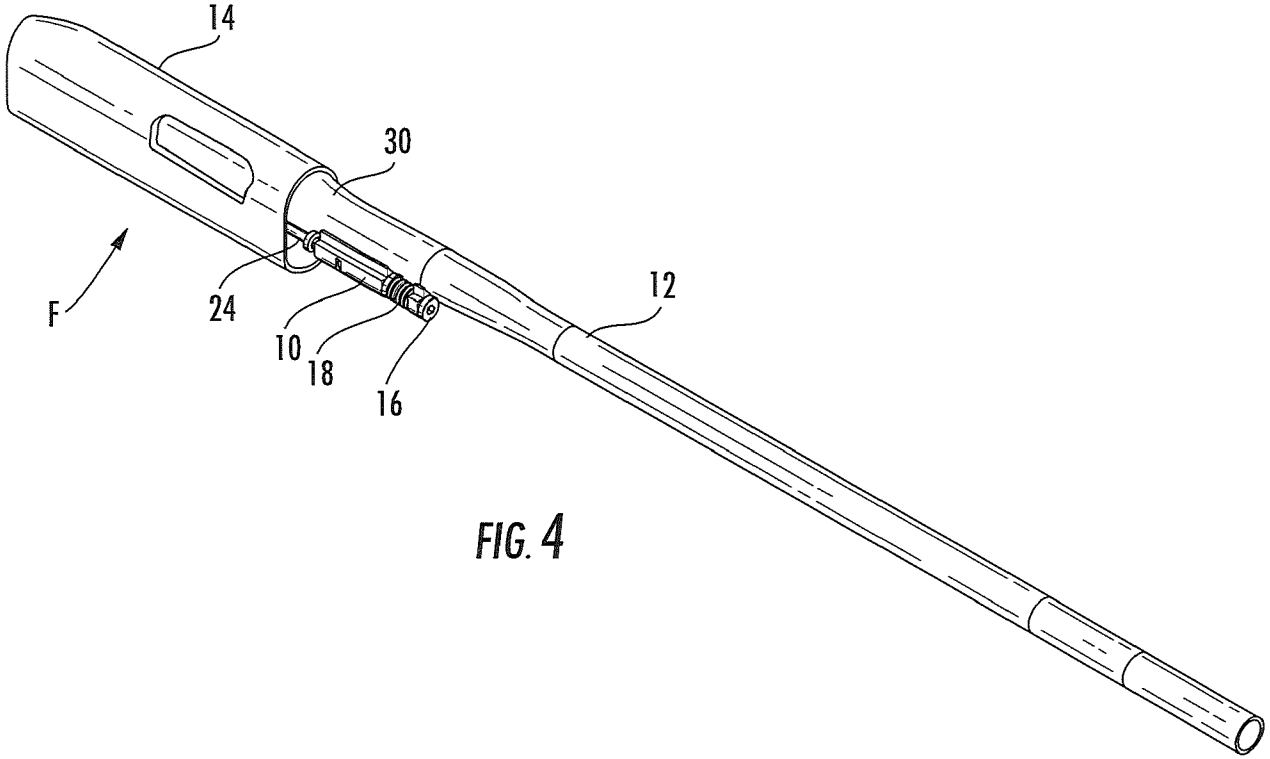
FIG. 4 illustrates an isometric view of the components of the gas cutoff system in an exemplary embodiment.

FIG. 4 illustrates an isometric view of the components of the gas cutoff system in an exemplary embodiment. This view shows gas block 10 mounted to barrel 12. Barrel 12 can be connected at shoulder 30 to the receiver 14. A portion of the piston 24 extends outside the gas block 10 and into receiver 14. Gas plug 16 is threadedly inserted into gas block 10. Spring 18 can be mounted on the gas plug 16 in a cut-out section of the gas block 10 before the gas plug is inserted into the gas cylinder 26.

Figure 5:
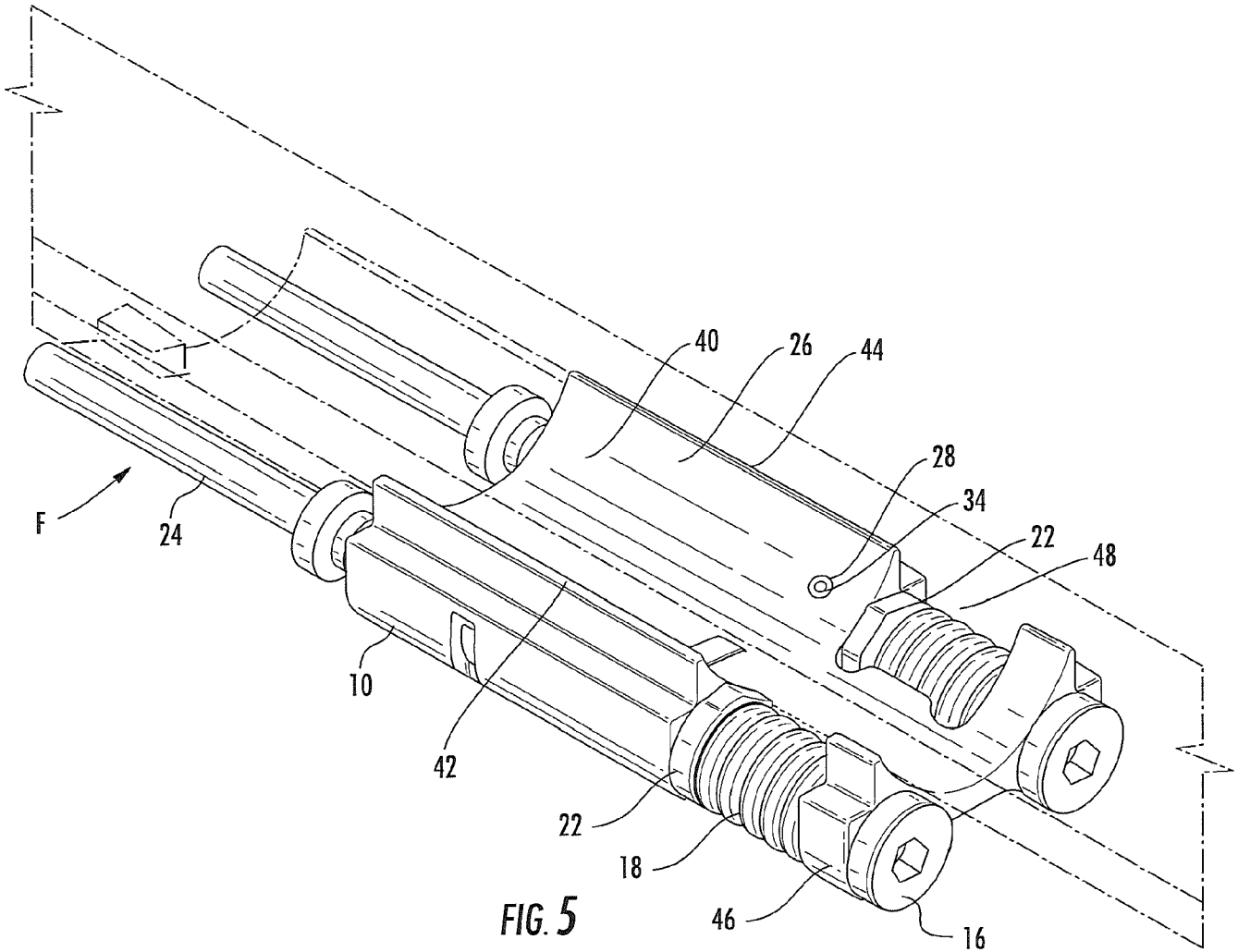
FIG. 5 illustrates an isometric cutaway view of the gas cutoff system in an exemplary embodiment.

FIG. 5 illustrates an isometric cutaway view of the gas cutoff system in an exemplary embodiment. The top portion of gas block 10 includes a curved upper surface 40 that can be attached to the barrel 12 by brazing, edges 42, 44 of the upper surface 40, front portion 46 of gas block 10, and cutout section 48 of gas block 10. Also shown is piston 24 extending past the back end of gas block 10. The valve 20 can be disposed within the gas block adjacent the gas cylinder piston 24 with the rim 22 of valve 20 positioned adjacent a forward edge of gas block 10. The diameter of rim 22 exceeds the diameter of the gas cylinder bore to retain the valve at the end of the gas cylinder bore. Gas plug 16 can be inserted through the forward end of gas block 10 and approximately halfway into the valve. The spring 18 can be slideably mounted onto the gas plug 16 between the valve rim 22 and the front portion 46 of gas block 10 in the cutout section 48. Also shown is orifice 28 in gas block 10 which aligns with orifice 34 in valve 20 until gases entering the valve though orifice 34 pushes against the valve 20 to move the valve forward thereby ending the alignment between the gas block orifice 28 and the valve orifice 34 until the next action cycle begins.

Figure 6:
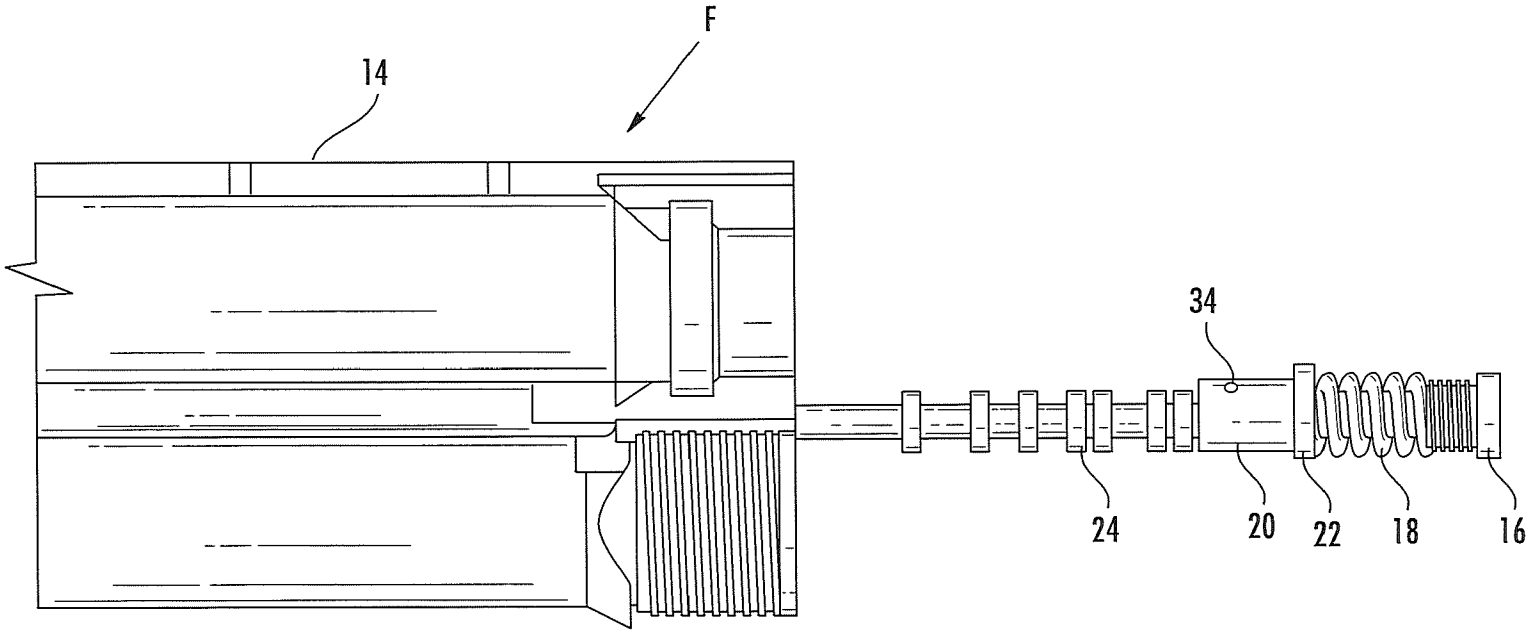
FIG. 6 illustrates a side cutaway view of the gas cutoff system in an exemplary embodiment.

FIG. 6 illustrates a side cutaway view of the components of the gas cutoff system in an exemplary embodiment. Gas block 10 is not shown for clarity. Valve 20 can be positioned in the cylinder bore adjacent the piston 24 which extends, at its opposite end, into receiver 14. Spring 18 is shown mounted on gas plug 16 which is threaded into the gas block and into the valve 20. Orifice 34 in the valve 20 is shown along with orifice 36 in barrel 12.

The orifice 34 in valve 20 contains an opening the size of which is tuned to allow the optimal amount of gas to flow into the gas cylinder 26. The body of the valve 20 is cylindrical with an outer diameter of the valve body sufficient to create a sliding seal in the gas cylinder 26, and with an inner diameter such that the resulting annular surface at the rear end of the valve 20, which is exposed to the pressure of the gas in the gas cylinder 26, determines the pressure level inside the gas cylinder 26 at which sufficient force is exerted by the valve 20 on the spring 18 to overcome the biasing force of the spring 18 and allow the valve 20 to actuate.

Figure 7:
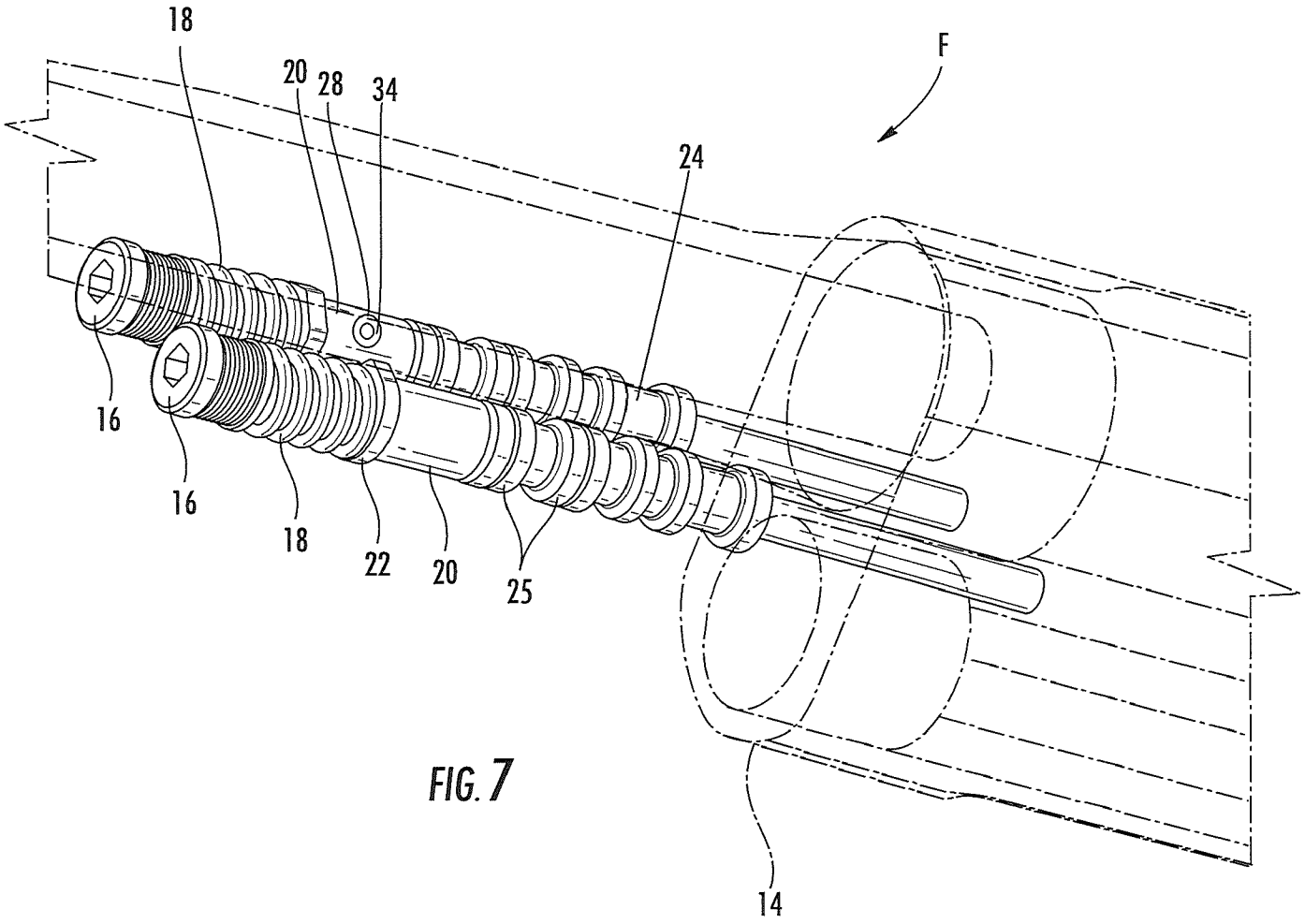
FIG. 7 illustrates an isometric view of the gas cutoff system having two symmetrically-aligned gas cylinders in an exemplary embodiment.

FIG. 7 illustrates an isometric view of the gas cutoff system having two symmetrically-aligned gas cylinders in the gas block in an exemplary embodiment. Gas block 10, gas cylinders 26, and barrel 12 are not shown for clarity. Receiver 14 is shown in transparent form. Piston 24 is shown positioned adjacent gas valve 20 in each gas cylinder. The piston is shown with a plurality of spaced-apart ridges 25, the most forward ridge abutting the valve 20. The ridges 25 provide a sliding seal in the gas cylinder. The reduction in piston diameter between the ridges reduces friction and the possibility of binding between the piston and cylinder. A portion of gas piston 24 extends outside the gas block and into the receiver 14. The rim 22 of valve 20 is positioned outside the gas block due to its larger diameter and abuts the rear end of spring 18 installed on the gas plug 16. The valve 20 compresses the spring when gases from the barrel enter the gas valve orifice 34 that is aligned with a gas block orifice 28 and overcomes the force of the spring causing forward movement of the valve 20. Between firings, the orifice 34 in valve 20 aligns with the larger oval-shaped orifice 28 in the gas block. The threads 17 on gas plug 16 screw into the gas block. The length of the gas plug is such that the gas plug extends about halfway through the valve 20.

Figure 8:
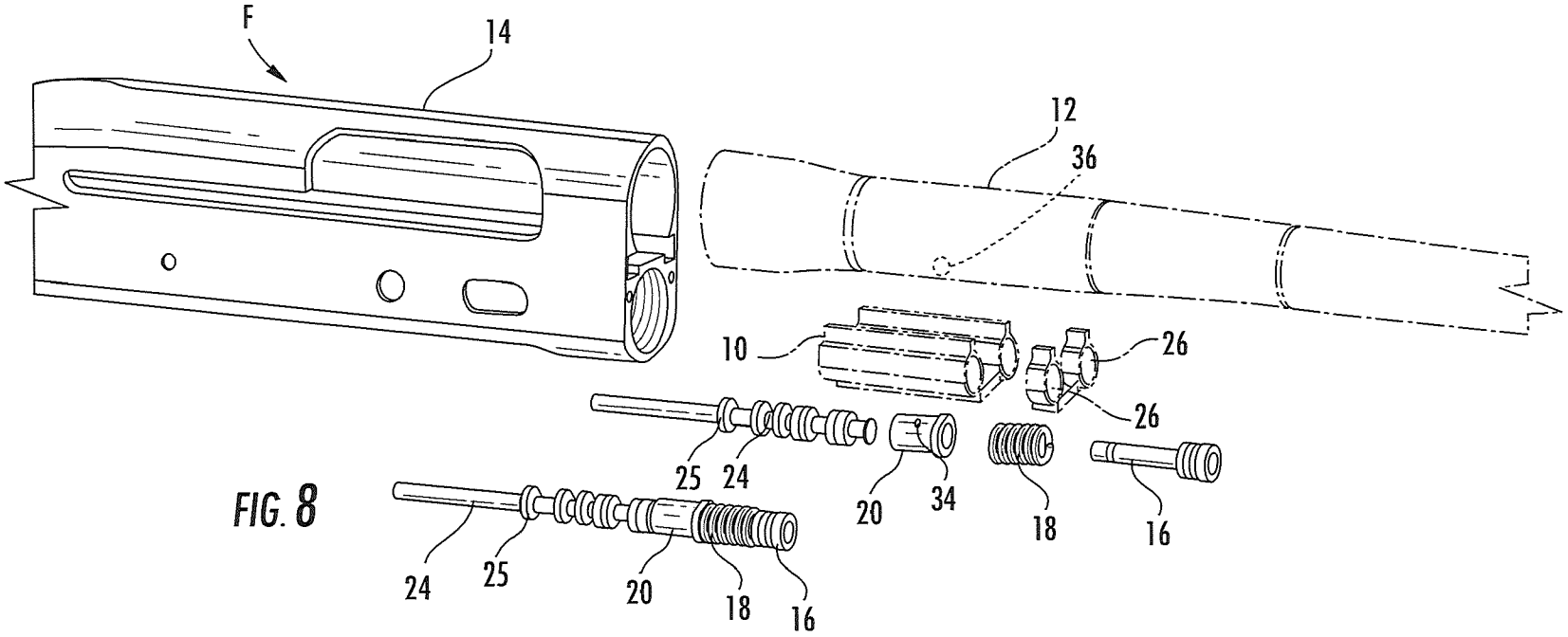
FIG. 8 illustrates an isometric view with parts broken away for clarity of the gas cutoff system in an exemplary embodiment.

FIG. 8 illustrates an isometric view of the gas cutoff system with parts broken away for clarity in an exemplary embodiment. Barrel 12, receiver 14, and gas block 10 with cylinder bores 26 are shown in transparent form. A portion of piston 24 including ridge 25 are positioned outside the gas block 10. The separate components show orifice 34 in valve 20 as well as the relative size of gas plug 16 and spring 18.

Figure 9:
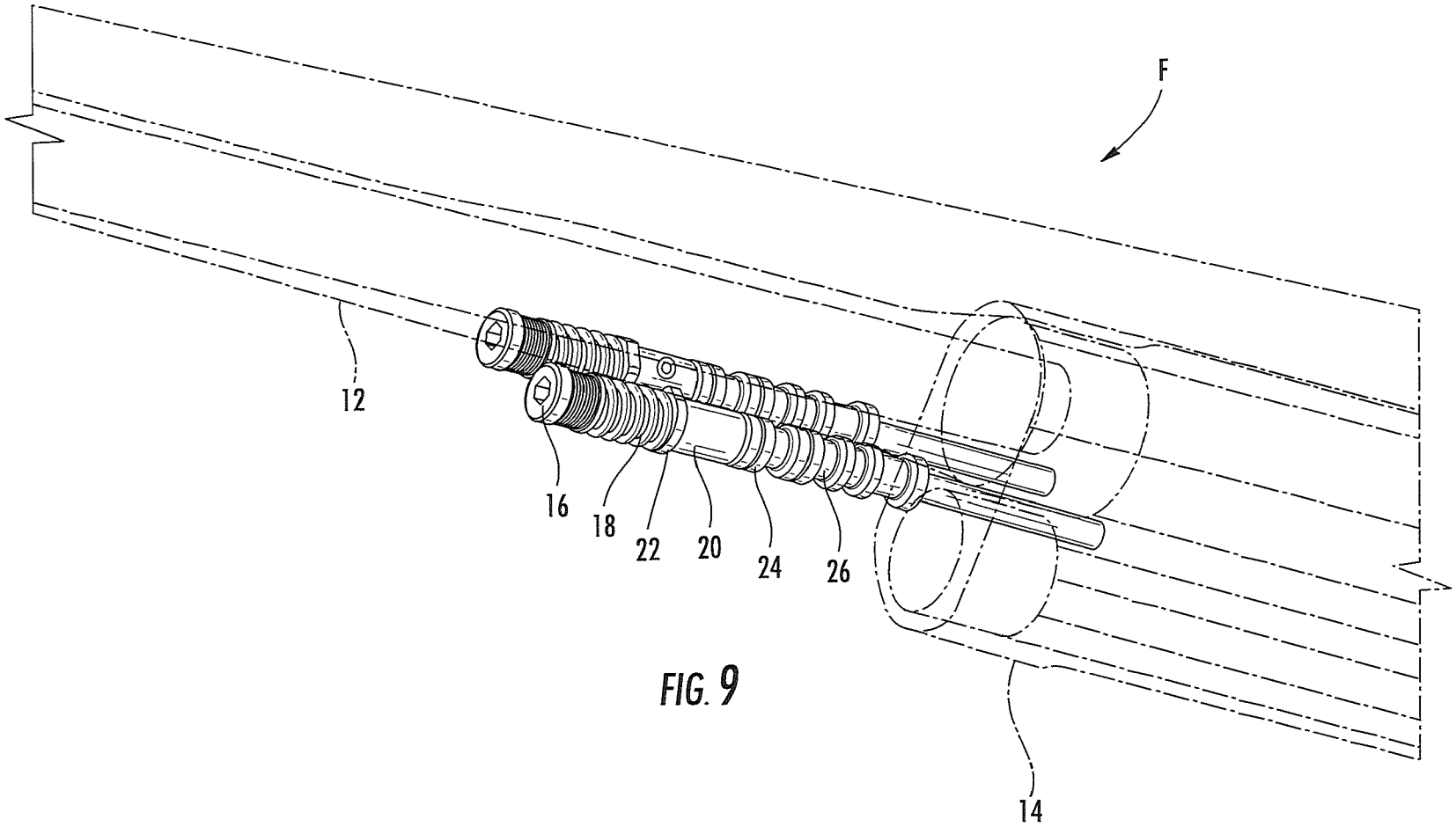
FIG. 9 illustrates another isometric view of the gas cutoff system having two symmetrically-aligned gas cylinders in an exemplary embodiment.

FIG. 9 illustrates another isometric view of the gas cutoff system having two symmetrically-aligned gas cylinders in an exemplary embodiment. This figure is similar to FIG. 7 but, in addition, shows barrel 12 in transparent form.

Figure 10:
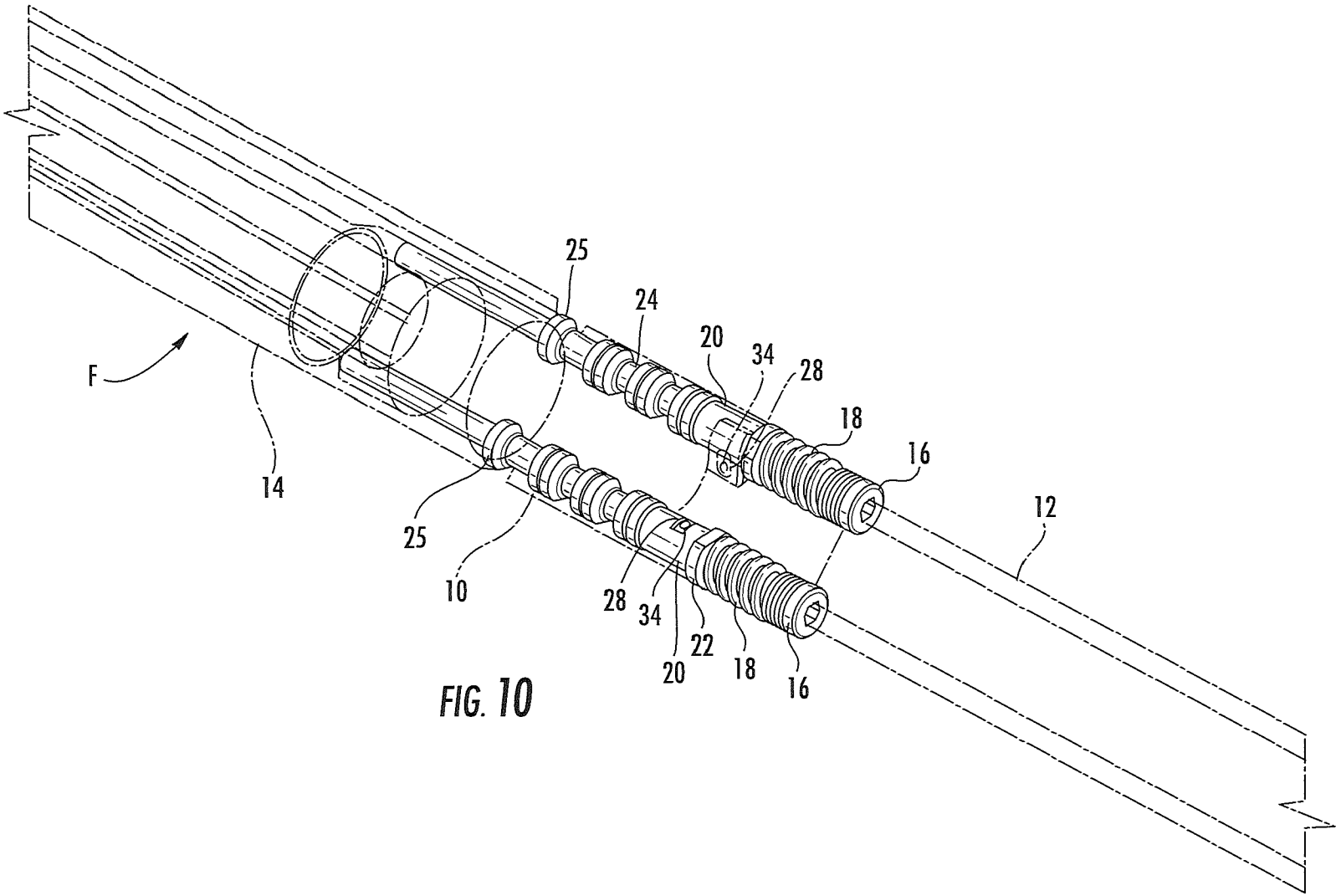
FIG. 10 illustrates another isometric view of the gas cutoff system having two symmetrically-aligned gas cylinders in an exemplary embodiment.

FIG. 10 illustrates another isometric view of the gas cutoff system having two symmetrically-aligned gas cylinders in an exemplary embodiment. Barrel 12, receiver 14, and gas block 10 are depicted in transparent form. The gas cylinders 26 are symmetrically disposed within the gas block 10 on opposite sides of barrel 12. This figure again shows the alignment of the piston 24, valve body 20, and gas plug 16 within each cylinder 26, with the spring 18 positioned on the outer surface of the gas plug 16 in a cutout section of the gas block 10 between the rim 22 of the valve 20 and the end of the cutout section. Movement of the gas valve 20 against the biasing force of the spring 18 will cause the valve orifice 34 to be offset from gas block orifice 28 and thereby block the flow of high pressure gas into the gas block 10.

The corresponding structures, materials, acts, and equivalents of all means plus function elements in any claims below are intended to include any structure, material, or acts for performing the function in combination with other claim elements as specifically claimed.

Those skilled in the art will appreciate that many modifications to the exemplary embodiments are possible without departing from the scope of the present invention. In addition, it is possible to use some of the features of the embodiments disclosed without the corresponding use of the other features. Accordingly, the foregoing description of the exemplary embodiments is provided for the purpose of illustrating the principles of the invention, and not in limitation thereof, since the scope of the invention is defined solely by the appended claims.

What is claimed:

1. A gas cut-off system for a gas operating system of a firearm having a barrel, comprising:

a gas block affixed to the barrel and including a plurality of openings adjacent the barrel for receiving gas redirected from the barrel;

at least one gas cylinder disposed within the gas block;

a piston disposed within and moveable along the gas cylinder; and a valve assembly disposed within the gas cylinder adjacent to the piston, the valve assembly including a selectively closeable valve and a spring applying a biasing force for urging the valve toward a substantially open position;

wherein the valve is movable along the gas cylinder in response to a volume or pressure of gas received from the barrel sufficient to overcome the biasing force applied to the valve by the spring to positions substantially restricting one or more of the plurality of openings to regulate an energy input to the gas operating system.

2. The gas cut-off system of claim 1 wherein a movement of the valve within the gas cylinder regulates the energy input by blocking or limiting a volume and a pressure of gas entering the gas operating system.

3. The gas cut-off system of claim 1 further comprising a gas plug securely threaded into one end of the gas block and into the valve assembly disposed in the gas cylinder.

4. The gas cut-off system of claim 1 wherein the valve includes an orifice or opening, the size of the opening being tuned to allow an optimal amount of gas to flow into the gas cylinder.

5. The gas cut-off system of claim 1 wherein the piston disposed within each gas cylinder extends through one end of the gas block and into a receiver of the firearm.

6. The gas cut-off system of claim 1 wherein the gas block is mounted to the barrel of the firearm by a brazing operation.

7. The gas cut-off system of claim 1 wherein an outer surface of the piston includes a plurality of spaced-apart ridges to reduce friction during sliding movement in the gas cylinder.

8. A gas cut-off system for a gas operating system of a firearm having a barrel, comprising:

a gas block affixed to the barrel and including a plurality of openings adjacent the barrel for receiving gas redirected from the barrel;

at least one gas cylinder disposed within the gas block;

a piston disposed within and moveable along the gas cylinder;

a valve assembly disposed within the gas cylinder adjacent to the piston, the valve assembly including a selectively closeable valve that regulates an energy input to the gas operating system;

a gas plug securely threaded into one end of the gas block and into the valve assembly disposed in the gas cylinder;

a spring slidably mounted on an outer surface of the gas plug in a cutout section of the gas block engaging a forward end of the valve assembly; and wherein the valve is actuated upon firing of the firearm when a volume and pressure of the gas entering the gas block through the plurality of openings in the gas block overcomes a biasing force of the spring so as to actuate movement of the valve within the gas cylinder, wherein a portion of the valve is moved to a location blocking the openings through which gas is entering the gas block from the barrel to prevent excess gas from entering the gas operating system.

9. The gas cut-off system of claim 8 wherein the valve includes a cylindrical body having an outer diameter sufficient to create a sliding seal in the gas cylinder, and having an inner diameter such that a resulting annular surface at a rear end of the valve exposed to the pressure of the gas in the gas cylinder determines the pressure level inside the gas cylinder at which sufficient force is exerted by the valve on the spring to overcome the biasing force of the spring.

10. The gas cut-off system of claim 8 wherein the spring is mounted over the gas plug such that the spring is in contact with the gas block at a first end and presses against a rim of the valve external to the gas block at a second end.

11. A gas block for use with a gas operating system of a firearm, comprising:

at least one gas cylinder bore disposed within the gas block;

a piston disposed within and moveable along the gas cylinder bore by a pressure of gases entering the gas block;

a valve assembly disposed within the gas cylinder bore adjacent to the piston, the valve assembly including a selectively closeable valve comprising a cylindrical body having an outer diameter sufficient to create a sliding seal in the gas cylinder bore, and having an inner diameter such that a resulting annular surface at a rear end of the valve exposed to the pressure of the gas in the gas cylinder determines the pressure level inside the gas cylinder at which sufficient force is exerted by the valve on a spring engaging the valve to overcome a biasing force of the spring.

12. The gas block of claim 11 wherein the valve further includes a rim portion that is positioned external to and abutting the gas cylinder bore, the rim having an outer diameter greater than the diameter of the gas cylinder bore.

13. The gas block of claim 11 further comprising a gas plug securely threaded into one end of the gas block and into the valve assembly.

14. The gas block of claim 11 further comprising an outer surface having a plurality of openings for receiving gas redirected from a barrel of the firearm upon firing.

15. The gas block of claim 11 wherein the valve includes an orifice or opening, the size of the opening being tuned to allow an optimal amount of gas to flow into the gas cylinder.

16. The gas block of claim 15 wherein movement of the valve within the gas cylinder bore blocks the opening in the valve and prevents gas from the barrel from entering the gas cylinder.

17. The gas block of claim 11 wherein the piston includes an outer surface of a varying diameter, the outer surface comprising a plurality of spaced-apart ridges to reduce friction during sliding movement along the gas cylinder bore.

18. The gas block of claim 11 wherein movement of the valve within the gas cylinder bore regulates the energy input by blocking or limiting a volume and a pressure of gas entering the gas operating system.

19. A gas block for use with a gas operating system of a firearm, comprising:

at least one gas cylinder bore disposed within the gas block;

a piston disposed within and moveable along the gas cylinder bore by a pressure of gases entering the gas block;

a valve assembly disposed within the gas cylinder bore adjacent to the piston; and a gas plug inserted into one end of the gas block and into the valve assembly;

wherein the valve assembly comprises a selectively closeable valve and a spring slidably mounted on an outer surface of the gas plug in a cutout section of the gas block engaging a valve rim of the valve at a forward end of the valve assembly.

20. A gas operating system for a firearm comprising:

a gas block affixed to a barrel of the firearm for receiving gas redirected from the barrel;

at least one gas cylinder disposed within the gas block for receiving gas redirected from the barrel;

a valve disposed within the gas cylinder that regulates an energy input to the gas operating system; and a spring mounted within the gas block in a position so as to exert a biasing force against the valve;

wherein the valve is caused to move along the gas cylinder when a volume and pressure of gas entering the gas block upon firing of the firearm is sufficient to overcome the biasing force exerted by the spring, such that a portion of the valve is moved to a location blocking or cutting off a flow of gas redirected from the barrel.

* * * * *